US005306957A

United States Patent [19]

Ellingham et al.

[11] Patent Number: 5,306,957

[45] Date of Patent: Apr. 26, 1994

[54] SWITCH LEVER OPERATING DEVICE WITH AUTOMATIC TIMER

[75] Inventors: Donald B. Ellingham, Greenwich, Conn.; Ofer Nissim, 1930 W. Main, Stamford, Conn. 06831

[73] Assignee: Ofer Nissim, Stamford, Conn.

[21] Appl. No.: 911,415

[22] Filed: Jul. 10, 1992

[51] Int. Cl.[5] ..... H01H 43/00

[52] U.S. Cl. ..... 307/141; 200/33 R

[58] Field of Search ..... 200/33 R, 35 R, 38 A, 200/38 F, 38 FA, 38 FB, 39 R; 307/112, 116, 141

[56] References Cited

U.S. PATENT DOCUMENTS

| | | | |
|---|---|---|---|
| 2,937,247 | 5/1960 | Laviana et al. | 200/38 |
| 3,179,758 | 4/1965 | Trock | 200/38 |
| 3,818,156 | 6/1974 | Augustyniak | 200/33 R |
| 3,985,982 | 10/1976 | Schneidinger | 200/33 R |
| 4,019,166 | 4/1977 | Lawrence et al. | 335/172 |
| 4,164,635 | 8/1979 | Finch et al. | 200/33 R |
| 4,521,722 | 4/1985 | Barthel et al. | 200/38 B X |
| 4,972,045 | 11/1990 | Primeau | 174/66 |

*Primary Examiner*—J. R. Scott

*Attorney, Agent, or Firm*—Gordon L. Hart

[57] ABSTRACT

For operating a switch which has a switch lever, such as a toggle switch lever, The invention provides a device which fits over the switch with the switch lever engaged by a slide on the device. Manual operation of the slide moves the switch lever from OFF to ON. The same operation of the slide starts a timer and sets a return mechanism which is retained at its set position by a latch until the timer at the end of a preset time interval actuates a release mechanism which retracts the latch. The return mechanism then returns the slide to turn the switch lever OFF. All of the operating parts, including a self-contained power source are within a housing that fits over the switch. In preferred embodiments the timer is a microcomputer chip. An optional time interval selector is described for presetting a selected time interval for the timer. A single manual movement of the slide causes the device to automatically execute the rest of its cycle.

11 Claims, 9 Drawing Sheets

Fig. 3b
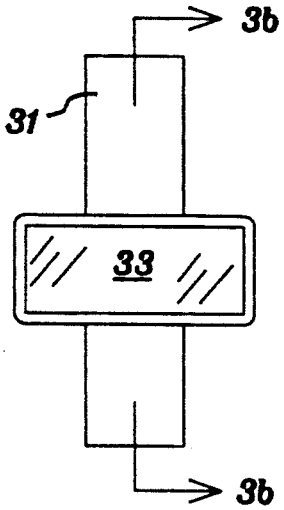
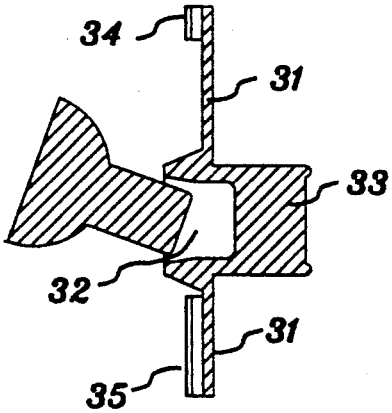
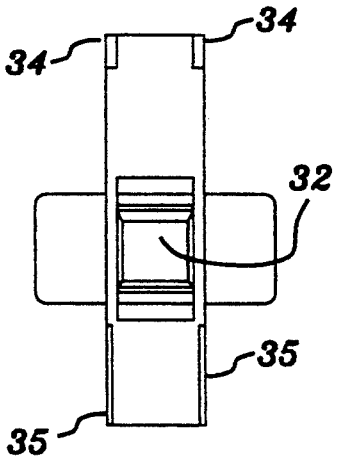
Fig. 3a
Fig. 3c
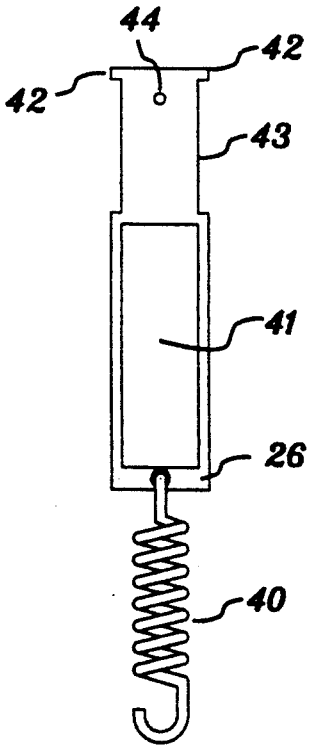
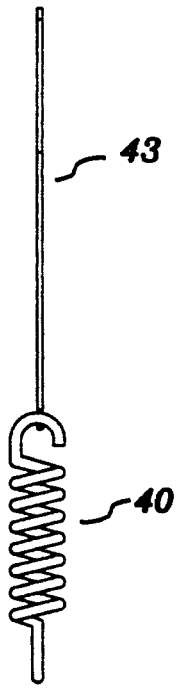
Fig. 4a
Fig. 4b

SWITCH LEVER OPERATING DEVICE WITH AUTOMATIC TIMER

SUMMARY OF THE INVENTION

The invention relates to improvements in a device for operating a switch which is equipped with a switch lever. More specifically the invention is a lever return device for automatically returning a switch lever after a measured time interval, from a manually set position to its opposite position. By the action of moving the switch lever manually to a set position, a return mechanism is cocked and is retained in a condition to return the lever when a retainer is tripped. Also, the action of moving the lever to its set (or cocked) position causes the mechanism to start a timer which measures a preset interval of time. At the end of that time interval, the timer actuates a release mechanism which trips the retainer and the return mechanism returns the switch lever.

The invention is useful for operation of a toggle switch of the kind having a lever that moves in a limited arc between opposite extreme positions for turning off or on electric lights or other electric appliances. In the following detailed description, the invention will be described by reference to its most preferred use, for operating such a toggle switch, with the understanding that the invention may also be used for operation of similar devices, for example a dimmer switch with a lever that moves back and forth between limits to any position on its arcuate or linear path to regulate a dimmer.

Other devices have been described in prior art for mechanically returning a switch lever from a manually set position. U.S. Pat. Nos. 4,019,166 and 2,937,247 described such devices. The present invention differs from those devices in several respects which are described herein.

One advantage of a preferred embodiment of the invention is that it can be entirely self-contained and needs no external power source. Small batteries within the device can furnish the necessary electric power to operate all of the electrical and electronic components of the device. Another advantage is that the device may be installed to operate a switch without disturbing the existing switch installation. In some preferred embodiments the device can be attached over a wall switch, with the switch lever extending inside the device, without even removing the face plate from the switch. Still another advantage is that the device automatically starts its timer whenever the return mechanism is set, without the need for the user to separately start the timer. The only manual action required to completely cycle the device, is to move the slide in one direction along its slide path.

One preferred use of the invention is for automatically switching off an electric light or appliance after a timed interval that starts when the light or appliance is turned on. To operate the device after it is installed, a slide is moved manually by means of a handle on the slide. Starting from one switch lever position, e.g. OFF, the slide moves the switch lever to its opposite position, e.g. ON. By the same action, the slide sets an automatic return mechanism and starts the timer. The rest of the cycle is automatic.

Some preferred embodiments have a time interval selector which can be manually preset to a selected time interval. The timer will operate at the selected interval whenever the timer is started.

The return mechanism, when set, is restrained from returning until the timer actuates a trip means to release the return mechanism which then automatically returns the slide which moves the toggle switch lever to OFF position.

BRIEF DESCRIPTION OF THE DRAWINGS

The invention is described in detail below with reference to the drawings which illustrate the invention including our presently most preferred embodiment.

In the drawings,

FIGS. 3*a*, 3*b*, and 3*c* respectively show front, side section and rear views of the slide member which engages and moves the switch lever and provides means for manual operation.

FIGS. 4*a* and 4*b* show front and side section views of the return member and its return spring.

DETAILED DESCRIPTION

Figure 1:
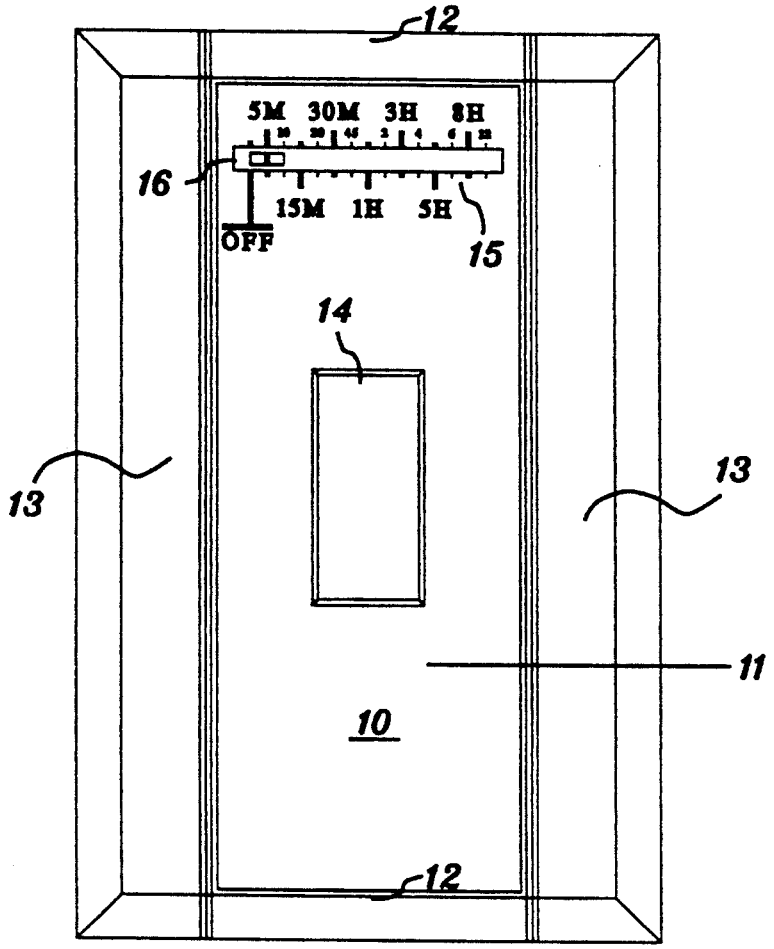
FIG. 1 is a view showing the outside front and sides of a housing for the device.

Referring now to FIG. 1, reference numeral 10 indicates a housing for the switch lever operating device of the invention. In the embodiment illustrated, this housing has a front cover 11, top and bottom walls 12 and side wings 13 which are further described below. An opening 14 near the center of the front cover of the housing is of a size to permit the handle member of an operating slide to extend outward through the opening and to move the slide through the full length of its slide path. Also on the front cover is a dial 15 with a graduated scale for indicating time interval values to which a time interval selector can be set. Slit 16 is an opening in the housing near the dial through which a selector handle extends from a sliding contact member inside the housing. The selector handle can be moved manually along the length of the slit to move the sliding contact member inside. The position of the selector handle in the slit will be at a time interval value on the scale which corresponds to the time interval setting of a time interval selector inside the housing.

A preferred height of the housing is slightly larger than that of a face plate which covers a wall switch, so that the edges of the top and bottom walls 12 will fit just outside the edges of the face plate. The width of the housing may be such that its side wings 13 similarly extend just beyond the side edges of the face plate. We prefer a design in which the width of the enclosure between side walls of the housing is somewhat narrower than the full width of a single-switch face plate so that housings of several devices can be fitted side by side over multi-gang switches, with each housing aligned with one of the switch levers on the gang. In such an embodiment the depth of the side walls of the housing may be also slightly reduced so their edges will clear the face plate as the top and bottom walls reach to the structure over which the switch plate is installed. The housing described in more detail below and illustrated in the drawings is an embodiment with such a narrowed housing enclosure and with side wings which may be detachable. The side wings can extend the housing to the edge of a face plate, when desired.

FIG. *2a* shows the top and bottom walls 12 and side walls 20 of the housing. These define the enclosure which contains all of the working parts of the invention. Each side wing 13 is an extension of the housing which may be detachable, and each comprises extensions of the front cover and the top and bottom walls of the housing beyond the side walls 20, with a wing side wall along the outer ends of said extensions. The side wings 13 are preferably attached to the housing by attachment means that will permit detachment of one or both side wings when one or both are not needed, as when two or more housings are fitted over a multi-gang switch. Such attachment means may be by mated snap-off fittings on the side wings and the housing, or by breakaway connectors, for example.

FIGS. *2a* and *2b* show the location inside the housing of three AAA size batteries 21 connected in series around the sides of the enclosure, a circuit board 22 fastened inside the housing at the rear, and a sliding contact switch 23 contacting an array of contact pads at the top of the circuit board. A small selector handle 24 extends from the sliding switch through a slit 16 near the dial on the front of the housing. Also shown at the front just inside the enclosure is a slide 25 which is the member that engages and moves the toggle switch. Here the slide 25 is shown in the position at which the toggle switch lever 27 is at its OFF position. FIG. *2a* shows only some of the parts shown in FIG. *2b*. Also shown in cross section in FIG. *2b* are the toggle switch lever 27 and face plate 28 of the toggle switch which are not parts of the device of the invention. The device of the invention in this embodiment is attached over the switch by means of Velcro tabs 29 fastened to the face plate 28 and opposed Velcro tabs 29 on the back of the circuit board 22 near the top and on a member of the housing near the bottom.

The slide 25 is positioned to move on its slide path in a plane that is parallel to the front of the housing. The side edges of the slide may engage guide pins or guide ridges fastened to the inside front of the housing (not shown). These guide pins or ridges will loosely engage the slide to hold it close to the inside front of the housing and will guide the slide as it moves along its slide path which is parallel to its side edges.

As shown in FIGS. *3a*, *3b* and *3c*, the slide comprises flat plate sections 31 above and below a notch 32 on the rear of the slide. The notch engages the toggle switch lever which extends from the rear into the notch. As the slide is moved along its slide path, the upper or lower edges of the notch move the toggle switch lever. The slide path corresponds to the path of the toggle switch lever and is long enough so that the notch can move the switch lever from either of its extreme positions to the other, e.g. from OFF to ON. Lift tabs 34 extend rearward from the upper corners of the upper plate section of the slide to engage the return member of a slide return mechanism as will be explained. The slide further comprises a slide handle 33 for manual operation of the slide. This handle is at the front of the slide and extends outward through an opening in the front cover of the housing for access to operate the slide manually. Flat plate sections 31 of the slide extend away from the notch 32 at least far enough for the slide to mask the opening in the housing front cover at any position of the slide and to carry the lift tabs 34 on the upper plate section 31. As shown in FIG. *3b* the handle 33 on the slide extends outward in front of the notch 32 serving to mask the notch from front view as well as to provide an outer member for manual operation of the slide. The part of the handle outside the housing may be extended horizontally as shown in these figures for more convenient manual operation of the slide. On the lower plate 31 of the slide at each edge are guides extending rearward with grooves which loosely retain the edges of the return member 26. Similarly, on the upper plate 31 of the slide, the lift tabs 34 have inner grooves which loosely engage the edges of the narrowed section of the return member.

FIGS. *4a* and *4b*, show a spring loaded return member 26 which is a part of the slide return mechanism. The return member 26 is a flat plate having a cut away lever-clearing slot 41 at its center, through which the toggle switch lever will pass. This slot 41 is large enough for the return member to clear the switch lever at all positions of the several members. The return member 26 at its upper end has extended ears 42 which engage lift tabs 34 on the slide. Below the ears the return member 26 has a narrowed section 43 to permit the lift tabs 34 on the slide to clear the return member 26 when the slide is manually moved down to turn OFF the toggle switch while the return mechanism stays cocked. The return member 26 also has a catch 44 for engaging a trip latch 54 to retain the return member 26 when the return member is lifted to its cocked position. The return mechanism cannot move until the trip latch is retracted. When the latch 54 is retracted, the return member 26 is returned by a return spring 40, fixed at one of its ends to the bottom of the return member 26 and fixed at its other end to the housing 10. The spring 40 will be loaded as the return member 26 is moved to its cocked position. The loaded spring 40 has force sufficient to return the return member 26, pull down the slide 25 and return the toggle lever when the trip latch 54 is retracted. The slide 25 is pulled down by means of the ears 42 on the return member 26 bearing against lift tabs 34 on the slide 25. The notch 32 on the slide returns the toggle switch lever 27 to its OFF position as the slide moves down.

Figure 5B:
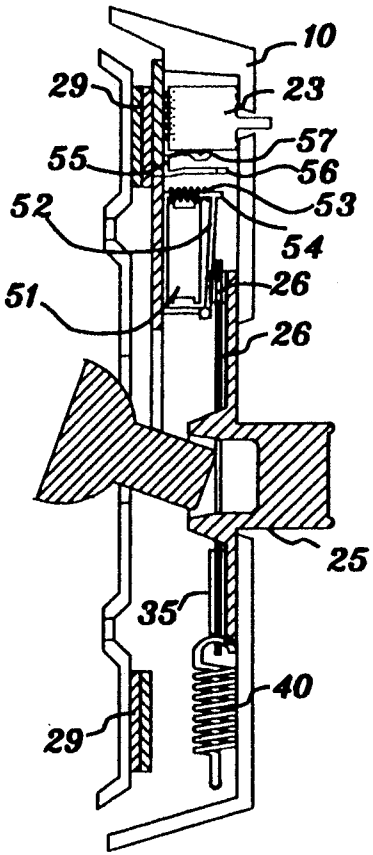
FIGS. 5*a* and 5*b* are rear and side views showing detail of the slide member and return member in the positions they occupy when the toggle switch lever is OFF and the return mechanism is not set for return.
Figure 5A:
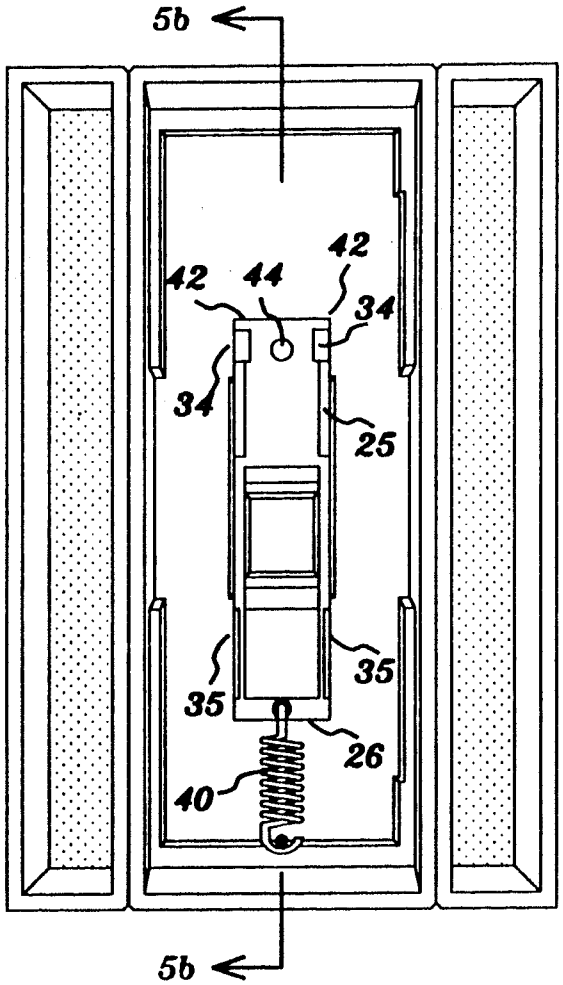

In FIGS. 5*a* and 5*b* the positions of the slide 25 and return member 26 are shown when the toggle switch is OFF and the return mechanism has not been set. The return spring 40 is relaxed and both the return member 26 and the slide are in their lower extreme positions. The slide 25 fits just inside the front of the enclosure and the return member 26 fits just behind the slide 25. Grooves in the lift tabs 34 and in guides 35 on the slide 25 hold the return member 26 close to the slide 25, but loosely enough to permit the lift tabs and guides to move along those edges that they retain. The engagement of the ears 42 on the return member 26 with the lift tabs 34 on the slide 25 is shown in these figures.

Figure 6B:
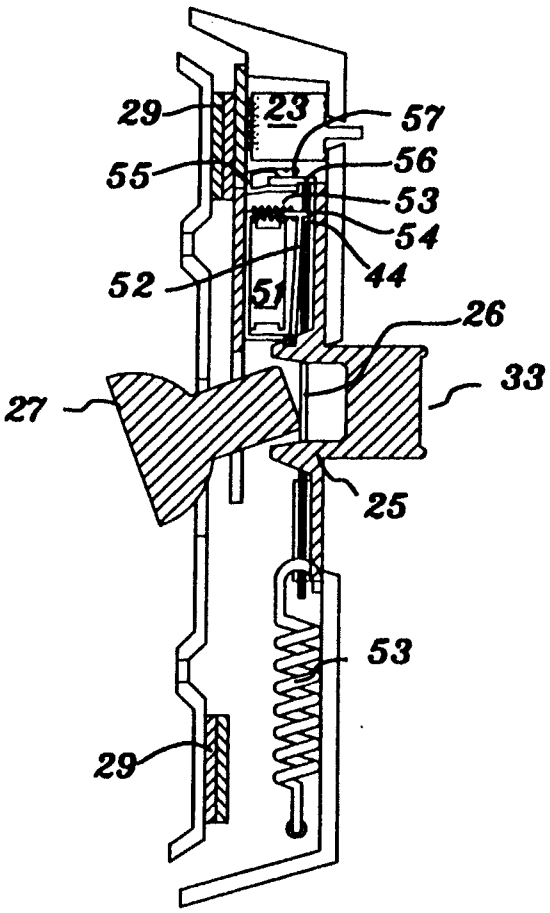
FIGS. 6*a* and 6*b* show detail of the same members when the switch is ON and the return mechanism is set for return.
Figure 6A:
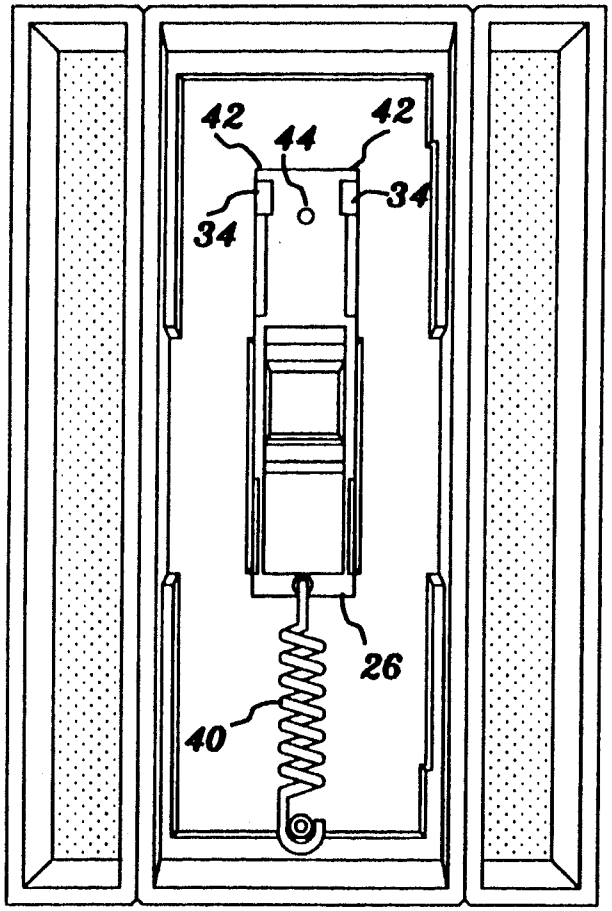
Figure 7A:
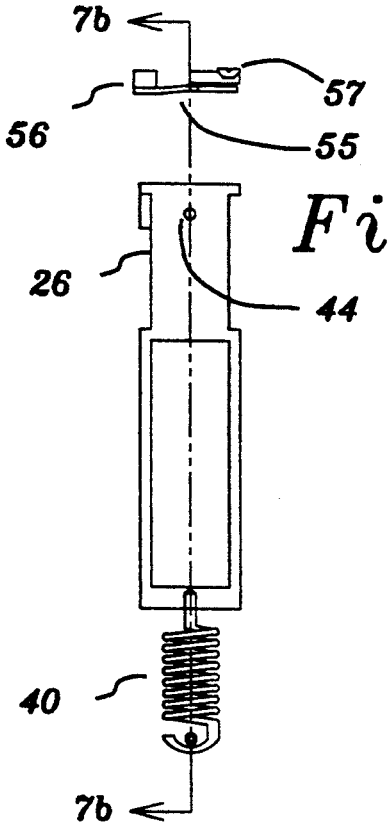
FIGS. 7*a* and 7*b* are front and side views of the return member, the solenoid and trip lever, and the timer switch, shown with the return member at its returned position.
Figure 7B:
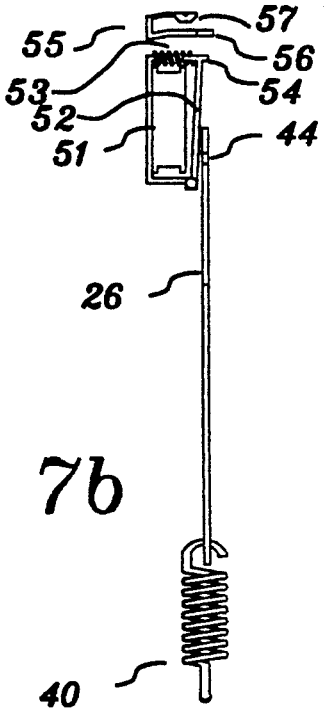
Figure 7C:
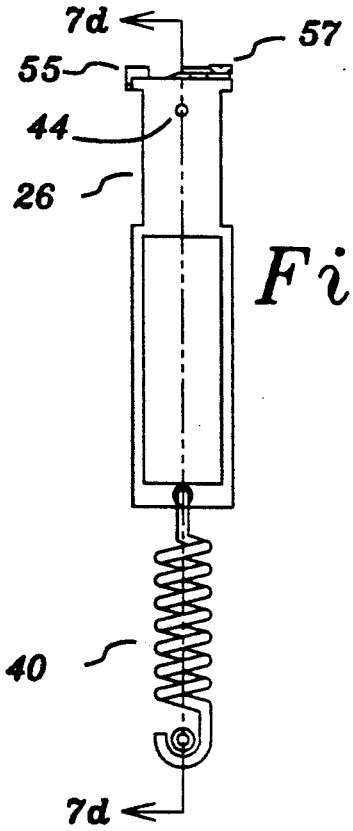
FIGS. 7*c* and 7*d* are the same but with the return member at its cocked position.
Figure 7D:
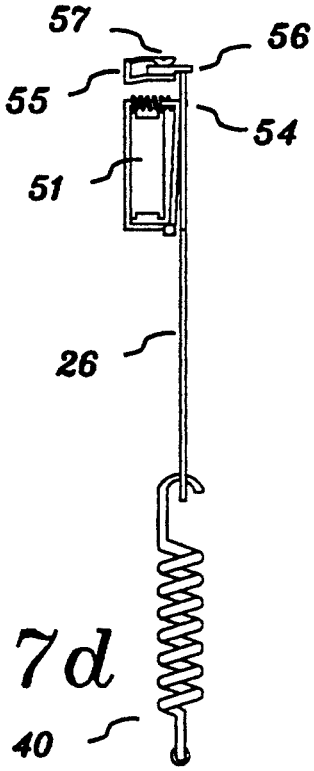

FIGS. 6*a* and 6*b* show the positions of the slide 25 and the return member 26 when the slide 25 has been manually moved by its slide handle 33 to move the toggle switch lever to ON. As the slide 25 was moved up, the lift tabs 34 on the slide 25 lifted the return member 26 by its ears 42 to its cocked position and loaded the return spring 40. The catch 44 has engaged the latch 54. After the latch 54 is engaged, the slide 25 can be manually moved downward to operate the switch lever without disengaging the latch 54 (not shown). When the latch is retracted, by automatic operation of the timer and the release mechanism, the spring 40 will return the return member 26 which in turn will pull down the slide 25 by the ears 42 bearing against the lift tabs 34. The toggle switch lever will be returned by the notch on the slide 25, as described above. If the slide has been moved down manually leaving the return member 26 cocked, the return member will nevertheless return when the latch 54 is withdrawn.

A latch release mechanism is also shown in FIGS. 5*a* and 5*b* and 6*a* and 6*b*. Mounted on a circuit board at the rear of the housing is a small solenoid 51 with a pivoted lever 52 on its front. The lever 52 is urged away from the solenoid 51 by a small latch spring 53. On the outer end of the lever 52 is a latch 54 aligned for engagement with the catch 44 on the return member 26. When the return member 26 is moved toward its cocked position the latch 54 rides over the upper end of the return member 26 and enters the catch 44 at the back of the return member. The latch 54 will remain in the catch 44 and will hold the return member 26 at its cocked position until the latch 54 is withdrawn. When the solenoid 51 is electrically actuated by the timer, the lever 52 on the solenoid is drawn back and retracts the latch 54, releasing the return mechanism.

A timer start switch 55 is located near and operated by the return member 26. In the embodiment shown in FIG. 5*b* the switch 55 is open and the timer is not powered. FIG. 6*b* shows the timer start switch 55 engaged by the cocked return member 26 holding the switch 55 closed to power the timer. The timer switch 55 comprises a leaf spring 56 contact and a fixed contact 57, both of which are mounted on the circuit board, spanning a gap in one of the power lines to timer components on the circuit board.

As shown in FIG. 7 the leaf spring contact 56 member of the timer start switch is connected at one of its ends to a power line on the circuit board. A conductor extends forward from the connection on the board and a leaf spring extends horizontally from that conductor, in front of the circuit board and behind the return member, toward the fixed contact 57 member of the timer start switch. On the outer end of the leaf spring is a contact point aligned for contact with a corresponding contact point on the fixed contact 57. The fixed contact 57 extends forward from its connection on the circuit board; at its forward end is a contact point aligned with the contact point on the end of the leaf spring. On the circuit board the fixed contact connects to the power line to the timer. Connection of contact points on the leaf spring 56 and the fixed contact 57 closes the power circuit to the timer. At the outer end of the leaf spring a tab extends forward for engagement with the top edge of the return member 26. The leaf spring holds apart the contact points but will yield as the return member is lifted to its cocked position. The top of the return member raises the tab on the outer end of the leaf spring and presses the contact points together to close the timer power circuit as illustrated in FIGS. 7*c* and 7*d*. When the return member returns, the leaf spring separates the contact points to open the timer start switch 55.

A preferred timer for use in the device of the invention is an electronic microcomputer chip with an oscillator that is controlled by a ceramic resonator. Three size AAA batteries located in the housing provide the power needed for the microcomputer chip and for a solenoid which retracts the trip latch. In the embodiment described, the microcomputer chip has been programmed to reset and then proceed to execute an internal timing program when the power circuit is closed by the timer start switch.

Figure 8:
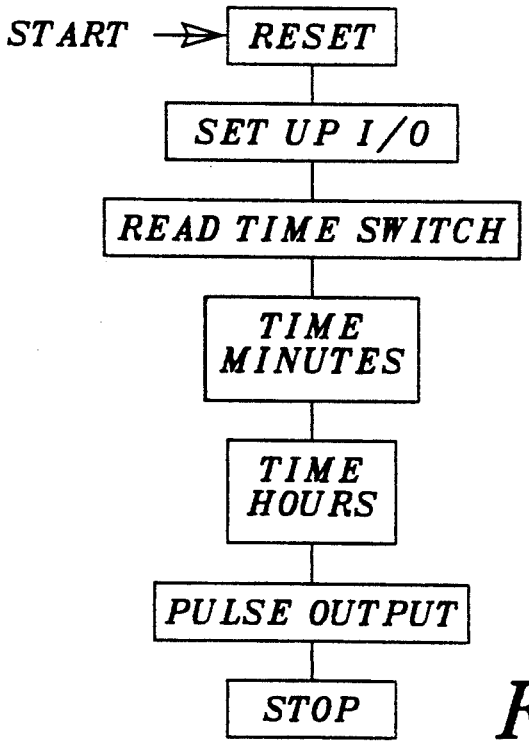
FIG. 8 is a block diagram of program for an electronic timer showing the sequence of steps by which a microcomputer controls the timing and release functions of the device.

In its programmed sequence for control of the timer, the microcomputer chip starts from reset and progresses in order through the several steps illustrated in the block diagram in FIG. 8. At START the power circuit has been closed and the microcomputer chip proceeds to RESET. After RESET, the input/output (I/O) ports on the microcomputer chip are assigned their functions. Next, the microcomputer chip reads the input from a variable time interval selector and uses that input to start measuring a selected time interval. The microcomputer chip is programmed to count oscillations from a resonator controlled oscillator to measure the selected time interval, first minutes then hours. At the end of the selected interval, the microcomputer chip sends a pulse of current through an I/O port to the solenoid 51 for a period just long enough for the solenoid to retract the latch. After the pulse output, the microcomputer chip stops. When the latch is retracted the timer start switch opens the power circuit and the timer is inactive. These steps will be explained in more detail with reference to the timer diagram in FIG. 9.

Figure 9:
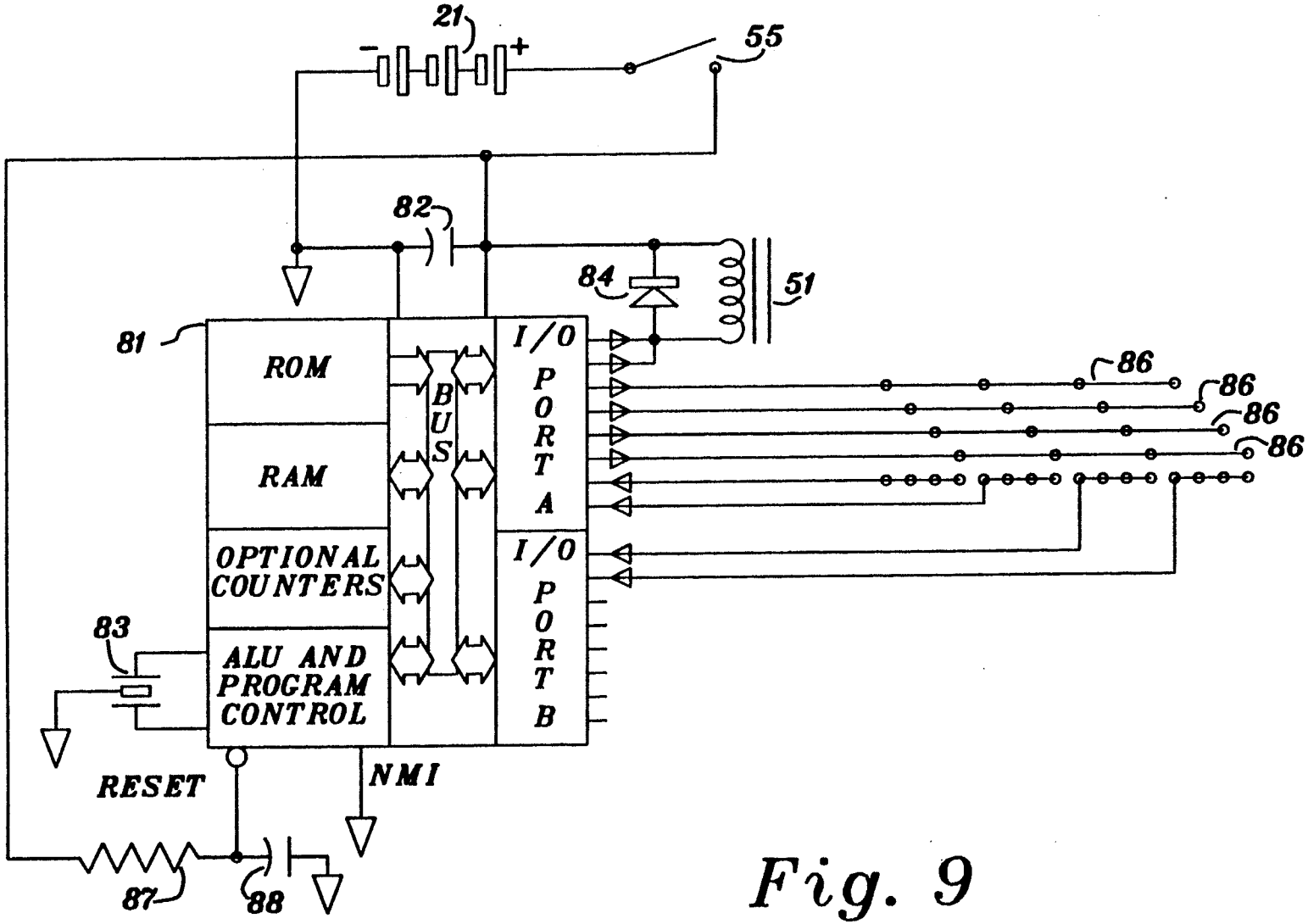
FIG. 9 is a diagram of a preferred timer showing a microcomputer chip with connections to its power source and peripheral components.

A preferred microcomputer chip for use in the invention is the Motorola HCMOS Microcontroller Unit MC68HC05K1. The large rectangle 81 in FIG. 9 is a diagram of the microcomputer chip. Shown diagrammatically outside the computer chip with connections thereto are, batteries 21, a capacitor 82 across power leads to the computer for noise protection of the microcomputer chip, a ceramic resonator 83, a solenoid 51, a diode 84 across power leads to the solenoid for protection of the microcomputer chip, a time interval selector array 86, a sliding contact switch 23, a reset resistor 87 and reset capacitor 88 which together provide the conventional means for power-up delay at reset when power to the microcomputer chip is turned on. The ceramic resonator 83 is connected through pins on the microcomputer chip to an oscillator on the microcomputer chip.

The time interval selector array has four parallel conductive lines each connected to a different output pin at the I/O port on the microcomputer chip. Each of those four lines is connected to four contact points on the array. The sixteen points on those four parallel lines are arranged in a pattern such that a line perpendicular to the four lines at any of the sixteen points will not contact any other of those points. On a fifth line parallel to the other four lines are sixteen points, arranged so that each of those points falls on a perpendicular line through one of the other sixteen points in the array. Every set of four of the sixteen points on the fifth line is connected to a different one of four input pins at the I/O port on the microcomputer chip.

A sliding contact switch 23 has five contact points on a line perpendicular to the five lines on the array. Each contact point on the switch is aligned with one of the five lines on the array. The sliding contact switch provides electrical connection between any two points that it contacts. The sliding switch is moved manually across the array on a path parallel to the lines of the array by means of the selector handle 24 which extends from the sliding switch through the slit 16 in the front cover of the housing as explained before. The handle 24 is movable across the length of the slit 16 to select a time interval. As the handle is moved to a selected time interval indicated on the dial, it moves the sliding switch to connect the pair of points on the array which lead to the pair of I/O pins that will signal the selected time interval when the microcomputer chip scans the I/O ports as will be explained.

As the switch moves across the array, at each position it connects a contact point on one of the four lines leading from an output pin with one of the contact points on the fifth line leading to an input pin. At each sliding switch position a different pair of input and output pins is connected. A potential difference is maintained between the input pins and the output pins; current will flow when a pair is connected through the selector array. The microcomputer chip is programmed to scan the I/O ports, detect which of the sixteen pairs of pins is connected and start counters to measure a time interval that has been assigned by the program to that pair.

When operation of the timer is not desired, the sliding switch is set at a position, preferably the left-most position, at which it connects a pair of pins that causes the microcomputer chip program to measure a short time interval and then reset before reaching the pulse output step. Thus the timer continuously cycles without actuating the solenoid. To resume operation, the sliding contact switch handle is moved to a desired time interval setting on the dial. In the next cycle, the I/O connection for that time interval is detected and the full cycle is carried out.

Figure 2B:
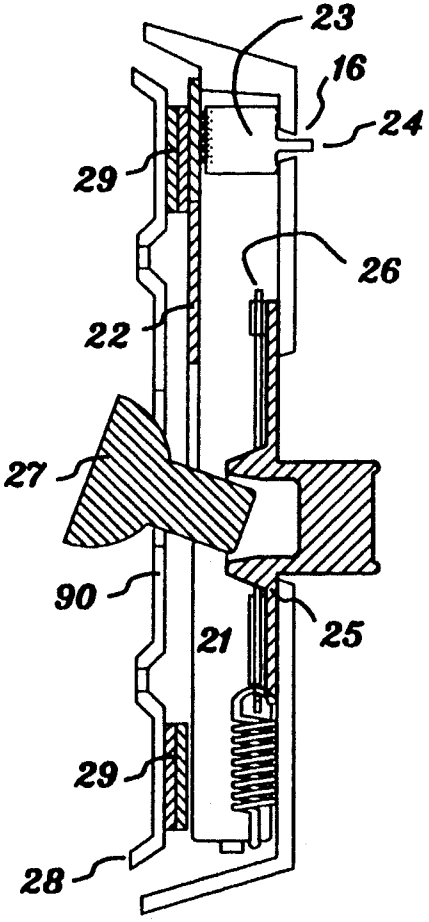
FIG. 2*b* is a side section view from FIG. 2*a* but with the front cover restored and with the addition of a toggle switch lever and face plate of a switch over which the device is installed.
Figure 2A:
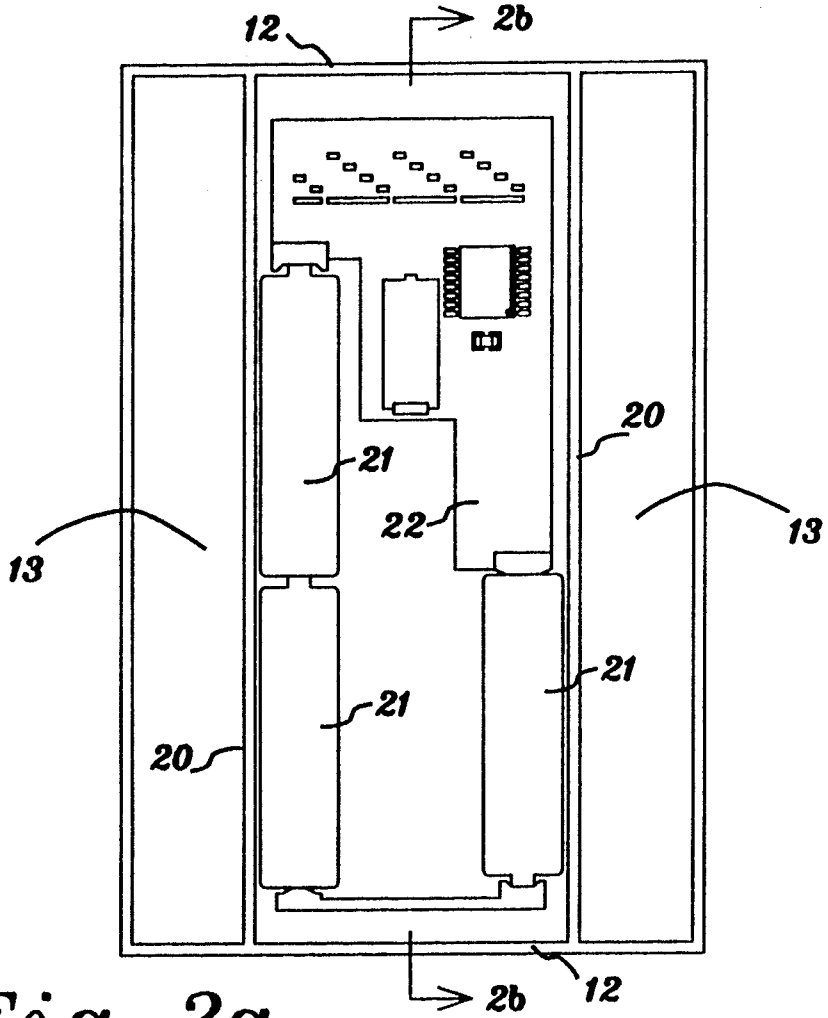
FIG. 2*a* is a view from the front with the front cover of the housing cut away to show other parts of the housing and the location of some of the parts contained inside.
Figure 10A:
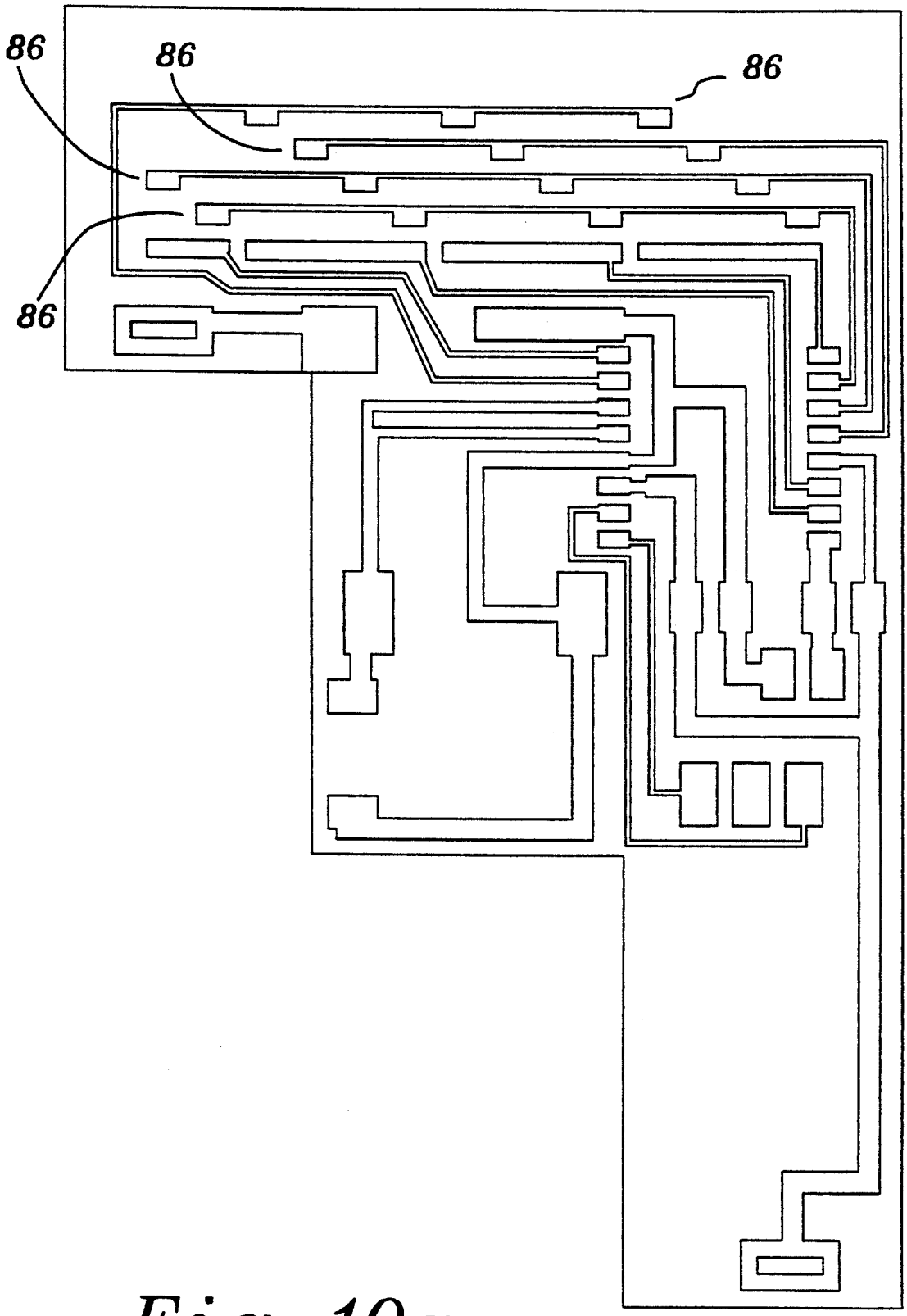
FIG. 10*a* is a plan for a printed circuit board on which components of the timer can be mounted.
Figure 10B:
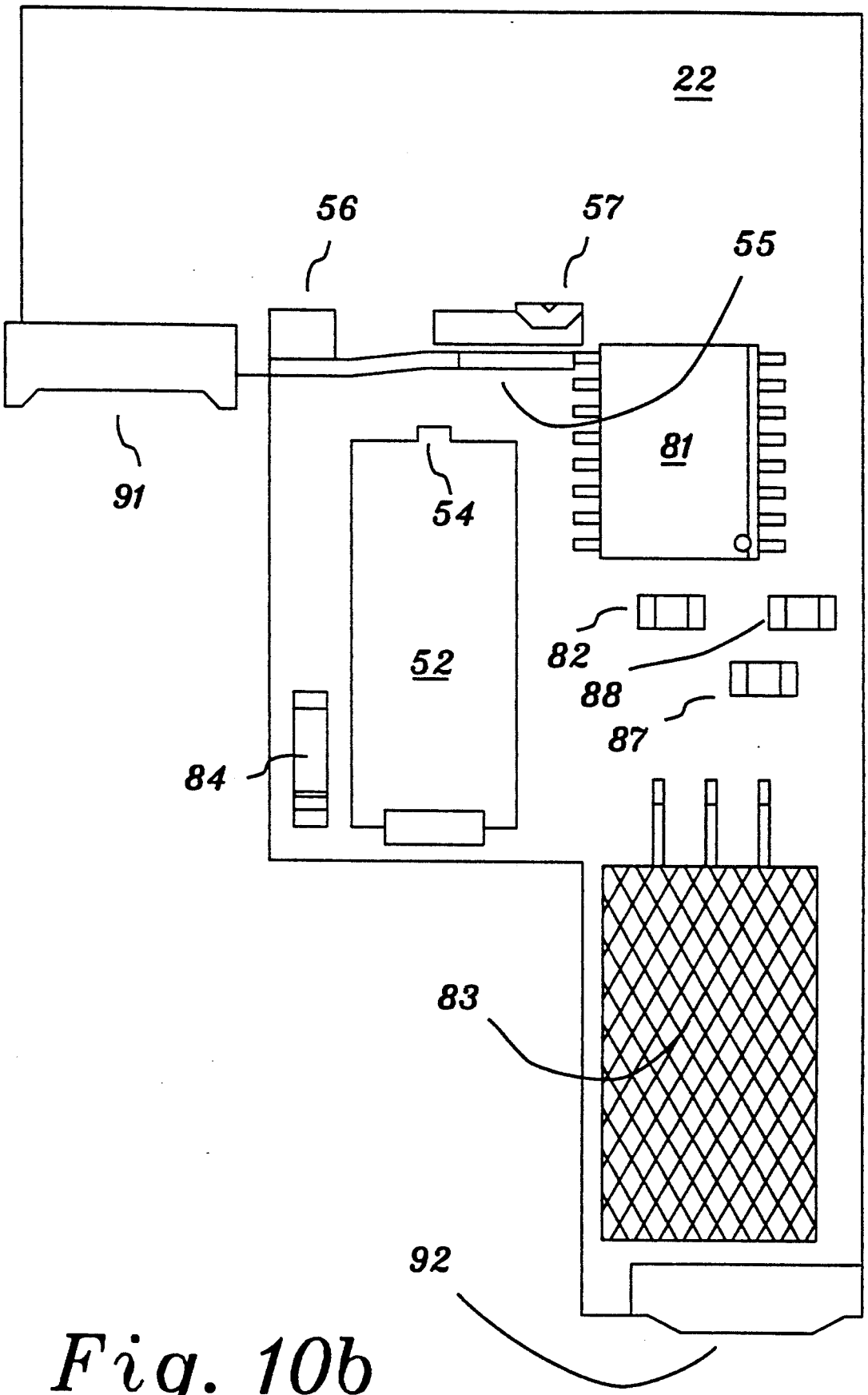
FIG. 10*b* is a plan view of the circuit board showing locations where timer components are mounted on the board for connection by printed circuit lines shown in FIG. 10*a*.

The plan shown in FIG. 10*a* is the printed circuit for a timer circuit board designed to be fastened inside the housing with other members. The array 86 for the time interval selector is shown at the top of the plan. The position of the circuit board inside the housing is illustrated in FIGS. 2*a* and 2*b*. The circuit board is a convenient and compact means for connecting and positioning some or all of the several electrical and electronic components of the preferred timer described in detail above. The positions on the circuit board of several on-board components is shown in FIG. 10*b*. These are the microcomputer chip 81, the capacitor 82, ceramic resonator 83, the solenoid lever 52 with the latch 54 shown in front of the solenoid which is connected to the circuit board, the diode 84, reset resistor 87 and reset capacitor 88, and the timer start switch 55 all described above. In FIG. 10*a* connector pads are shown at corresponding positions on the circuit board plan for connecting the on-board components shown in FIG. 10*b* to the printed circuit. Also on the circuit board are one battery contact 91 for contact to the positive pole of the battery series and another battery contact 92 for contact to the negative pole.

Printed circuit lines connect the battery contacts 91 and 92 to pins on the microcomputer chip and to the protective capacitor 82 connected in parallel with the microcomputer chip. The array 86 for the time interval selector, depicted schematically in FIG. 9, is printed at the top of the circuit board in FIG. 10*a*. The contact pads shown on the five parallel lines are the contact points in the array described above. On the circuit board plan, only fourteen combinations are used because of space limitations. The pads are connected by printed circuit lines to I/O pins on the microcomputer chip as described above. On the fifth line in the array, each long pad serves the function of four connected contact points on the fifth line in FIG. 9. When the timer start switch is closed, supplying power to the microcomputer chip, the reset resistor 87 and reset capacitor 88 cause a short delay at reset to allow the microcomputer chip to power-up before it proceeds to execution of the program.

It is preferred to cover parts of the circuit board with an insulating mask that is placed over the face of the circuit board to prevent inadvertent electrical contact with conductive lines and other elements. Openings are provided in the mask to permit contact where desired; e.g. for contact between contact points on a sliding switch and contact pads on the selector switch array. The insulating mask will prevent contact of contact points on the switch with printed circuit lines on the circuit board. Other openings are provided in the mask to clear components that stand out from the face of the circuit board.

Other embodiments of the invention may use variations of the several means and parts described above. For means to attach the housing and its contents to a switch, instead of using Velcro pads as described, a more secure attachment can be obtained by replacing a decorative face plate on the switch with a new face plate which has fittings for attachment of the plate to the switch by screws and has other fittings by which the new plate can be attached by screws to the housing of the device, which will have corresponding fittings.

Slide return mechanisms other than the one described above can be used instead. In another suitable mechanism the return member is a spring loaded cam which can be rotated in one direction, e.g. clockwise, to a cocked position by the slide bearing against the cam as the slide is manually moved along its slide path. The cam is retained by engagement of a catch on the cam with retractable latch means which will be actuated by the timer. When the latch is retracted the cam is returned by spring means, e.g. a rotary spring, which has been loaded for return as the cam rotated to its cocked position. The cam operates a timer start switch as it rotates to and away from its cocked position.

The timer may be any electrical, electronic or mechanical timer that can be started by the action of moving the return member to its cocked position and that can actuate a latch release mechanism at the end of a preset time interval. In one variation of the timer described above, a time interval selector is not used; when it is desired to use only one time interval for all operations, that time interval can be preset in the computer program. The microcomputer chip proceeds from start to measure the preset time interval and then to actuate the latch release. Instead of a ceramic resonator, another suitable resonator, such as a quartz crystal for example, may be used.

In a variation for starting the timer, the microcomputer chip is constantly powered and the timer start switch is wired to the microcomputer chip to reset the microcomputer chip when the switch is turned on by the return mechanism. When the microcomputer chip finishes execution of the routine it goes to a low power mode at which it stays until the next reset.

We claim:

1. A device for operation of a switch which has a switch lever movable between extreme lever positions, said device comprising:

a housing defining an enclosure in which are contained a slide, a slide return mechanism, a timer, and means for starting the timer;

said housing having means for attaching the housing to a switch having a switch lever for engagement with the slide;

said slide comprising means for engaging and moving a switch lever between its extreme positions by moving the slide along a slide path;

handle means extending outward from the enclosure through an opening in said housing and operable from outside the enclosure for manually moving the slide along its slide path;

said slide return mechanism comprising a return member movable to a cocked position by said slide as said slide is moved manually from one end of its slide path to the other end, spring means for returning said return member from said cocked position, said spring means being loaded for return by the action of manually moving said slide to said other end of its slide path, latch means for engaging and retaining said return member at said cocked position, latch release means actuated by the timer for retracting the latch means to release the return member for return by spring means, and slide return means for returning said slide to said one end of its slide path by the action of returning the return member;

said means for starting the timer being actuated by the manual action of moving said return member to said cocked position;

said timer comprising a computer chip programmed to respond to said means for starting the timer, and to measure a preset time interval from when the timer is started and to actuate said latch release means at the end of said interval.

2. A device for operation of a switch defined by claim 1 wherein the defined timer is an electrically operated timer and said means for starting the timer is an electric switch and said device further comprises, within the enclosure defined by the housing, power supply means for operation of the timer.

3. A device defined by claim 2 wherein the latch means comprises a catch on the return member and a retractable latch urged toward said catch to engage said catch and retain the return member at its cocked position.

4. A device defined by claim 3 wherein the defined latch release means comprises electromechanical means for retracting the latch from the catch when actuated by the timer, said electromechanical means being powered by the defined power supply means within the enclosure.

5. A device defined by claim 4 wherein the electrically operated timer comprises a microcomputer chip programmed to measure a preset interval of time from start and, at the end of said interval to electrically actuate the electromechanical means for retracting the latch.

6. A device defined by claim 2 further comprising time interval selector means for manual selection of a time interval and for presetting the timer to measure the selected time interval from start of the timer.

7. A device defined by claim 6 wherein the defined timer is a programmed microcomputer chip and the time interval selector comprises means for connecting one different pair of pins on the I/O port of the microcomputer chip for every time interval that is available for selection, and the microcomputer chip is programmed to detect which one of said pairs of pins is connected and to measure the time interval that has been assigned by the program to that pair of connected pins.

8. A device defined by claim 1 wherein the slide is manually movable to any position on its slide path while the return member is retained at its cocked position.

9. A device defined by claim 1 wherein the housing further comprises at least one detachable side wing comprising extensions of the front cover and the top and bottom walls of the housing beyond at least one of the side walls which define the enclosure in which the defined operating parts of the device are contained, and a wing side wall at the outer end of said extensions.

10. A device defined by claim 5 wherein the microcomputer chip is mounted on a circuit board with printed circuit connections between the microcomputer chip and peripheral components also mounted on the circuit board.

11. A device defined by claim 10 further comprising an array on said circuit board of more than one electrical contact points connected to output pins at an I/O port on the microcomputer chip and an equal number of electrical contact points connected to input pins at an I/O port of the microcomputer chip, said array being arranged on the circuit board in a pattern so that for each different pair of said contact points on the array that is connected a different pair of input and output pins at the I/O port is connected, and further comprising a selector contact switch for selecting and connecting any one of said pairs of contact points to connect the corresponding pair of input and output pins on the microcomputer chip, and the microcomputer chip is programmed to measure a different time interval for each of said different pairs of connected input and output pins.

* * * * *